US005479325A

United States Patent [19]

Chien

[11] Patent Number: 5,479,325

[45] Date of Patent: Dec. 26, 1995

[54] HEADGEAR WITH AN EL LIGHT STRIP

[76] Inventor: Tseng-Lu Chien, 8th Fl.-6, No. 9, San Min Rd., Taipei, Taiwan

[21] Appl. No.: 436,007

[22] Filed: May 5, 1995

Related U.S. Application Data

[63] Continuation of Ser. No. 226,329, Apr. 12, 1994.

[51] Int. Cl.[6] ..... F21L 15/14

[52] U.S. Cl. ..... 362/105; 362/84; 362/158; 362/276; 362/802; 362/808; 362/812; 40/544; 2/422; 2/906

[58] Field of Search ..... 362/84, 103, 105, 362/106, 158, 267, 276, 802, 806–808, 812; 40/544; 2/422, 906

[56] References Cited

U.S. PATENT DOCUMENTS

| | | | |
|---|---|---|---|
| 4,891,736 | 1/1990 | Gouda | 362/105 |
| 4,901,211 | 2/1990 | Shen | 362/106 |
| 4,999,936 | 3/1991 | Calamia et al. | 40/544 |
| 5,067,063 | 11/1991 | Granneman et al. | 362/84 |
| 5,111,366 | 5/1992 | Rife et al. | 362/106 |
| 5,426,792 | 6/1995 | Murasko | 362/105 |

*Primary Examiner*—Ira S. Lazarus

*Assistant Examiner*—Alan B. Cariaso

*Attorney, Agent, or Firm*—Bacon & Thomas

[57] ABSTRACT

An item of headgear attached with an EL light strip or strips includes a direct current power source for providing a direct current, a switch electrically connected to the direct current power source, a direct current/alternating current converter electrically connected to direct current power source via the switch for converting the direct current from the direct current power source to an alternating current with a predetermined frequency, a transformer electrically connected to the direct current/alternating current converter for amplifying the alternating current therefrom to have a predetermined voltage, a function stage electrically connected to the transformer for generating different pulses in response to reception the alternating current from the transformer, at least one EL light strip electrically connected to the function stage for receiving the pulses and activated thereby to light, a transparent enclosure for receiving the EL light strip therein, a colored transparent ink print or a nontransparent print being printed on the transparent enclosure thus forming a light design for the EL light strip, an attachment media for attaching the sleeve including the EL light strip onto the headgear, a waterproof housing attached on the headgear and receiving the direct current power source, the switch, the direct current/alternating current converter, the transformer, and the function stage.

25 Claims, 6 Drawing Sheets

HEADGEAR WITH AN EL LIGHT STRIP

BACKGROUND OF THE INVENTION

This is a continuation application of the U.S. patent application Ser. No. 08/226,329 filed Apr. 12, 1994 which is pending now. This invention relates to an item of headgear with at least an EL light strip attached thereto. The lighted headgear item may be a cap, a hat, a head band, a visor, or a helmet for people to protect their head and more particularly to signal to other people.

Some types of headgear and, particularly, sports headgear use light emitting diodes (LEDs) as light sources for purposes of decoration or signal. However, LEDs only provide a very narrow viewing angle thus limiting the visible range of the lighted headgear. Also, the LEDs are difficult to be assembled onto headgear and are fragile. Therefore it is requisite to provide a new light source which is composed of super flexible material which is easily assembled to headgear by simple attachment medium and provides a relatively larger visible angle range than the LEDs.

There are some types of headgear utilizing bulbs as a light source to replace LEDs. U.S. Pat. No. 5,111,366 illustrates a baseball-type cap having illumination and display means on a front portion of the cap. However, the illumination and display means involves a plurality of bulbs each of which requires a notch defined in a panel to receive it. Therefore, this illumination cap suffers the problems as previously mentioned, such as difficulty in assembly and a tendency to be damage due to the fragile nature of the bulbs. U.S. Pat. No. 4,901,211 illustrates a visor structure provided for displaying indicia illuminated by a light mounted to the visor structure. However the light is a bulb or the like, thus it is apt to be broken due to accidental impact. European Patent Office publication No. 0,166,534 provides a visual indicator safety device comprising one or more electroluminescent lamp devices being electrically connected to a DC power supply via a control circuit which includes a power DC/AC converter and an interrupt/flashing circuit which when operative interrupts the power supply to the converter to cause the electroluminescent lamp device or devices to flash. In the European Patent publication No. 0,166,534, the inventor further points out that the carrier may take the form of a waistcoat or a helmet, and the electroluminescent lamp devices are illustrated as being triangular in plan view or can have any other desired shape. Each electroluminescent lamp device is in flat form and contained in a plastic envelope which is attached to the carrier. The plastic envelope comprises four layers of a fluorohalocarbon transparent film on each side of the electroluminescent lamp. The plastics envelope extends beyond the sides of the electroluminescent lamp and is secured to the carrier by stitching or welding or by an adhesive. The European publication No. 0,166,534 discloses the electroluminescent lamp device and prevents the problems as faced in the U.S. Pat. Nos. 4,901,211 and 5,111,366. However, there are drawbacks existing in this publication. For example, the attachment of the plastic envelope is by stitching, welding, or by an adhesive thus when the user wants to change the illumination shape (or pattern) of electroluminescent lamp device he is apt to damage the carrier. Moreover, the publication No. 0,166,534 employs four layers of transparent film on each side of the electroluminescent lamp thus resulting in relatively greater cost in film. The publication No. 0,166,534 merely provides the electroluminescent lamp in different shapes, thus the light pattern emitted from the lamps is limited to the shape of the lamp. The publication No. 0,166,534 discloses that the electroluminescent lamp is attached on the carrier by stitching or welding or by an adhesive. However, it is well known that the helmet is usually made of hard material which does not permit stitching thereon. The publication No. 0,166,534 discloses that the carrier may take the form of a waistcoat or a helmet. However, it does not disclose anywhere in the specification how the battery container is installed on the helmet. For example, if the battery container is attached to the helmet by the same way as the electroluminescent lamp is attached to the belt, i.e., by an adhesive, then it is very difficult to change the battery without destroying the container.

The current invention concentrates to improve the viewing angle problem occurring in the LED design. Also, the present invention costs less than hooking together many LEDs. Moreover, the LEDs occupy too much space and the height (thickness) thereof creates difficulty for a manufacturer to install the LEDs on the headgear, while the present invention does not have the installation problem.

There are two pairs of patents which are light safety devices and have almost identical similarities. The three pairs of patents are granted basing on a minor difference as follows:

U.S. Pat. No. 5,151,678 "Safety Belt" is patentable over U.S. Pat. No. 5,245,516 "Illumination Device". The two patents both are used for E.L. belts. The differences 9 between the two patents are the location of the power pack and the method for adjusting the length of the belt. This minor difference results in two patents.

U.S. Pat. No. 5,245,517 "Lighted Bicycle Carrier Bag" is granted over U.S. Pat. No. 5,067,063 "Handbag Lit with Electroluminescence". Both the two patents almost have the same electric theory, the same electroluminescent components, the same function, and used in the bag. The only difference is the final products in the two patents are different, i.e., both patents utilizes the same structure and theory in different final products. The two patents are granted due to different classifications, not different structures.

SUMMARY OF THE INVENTION

It is the primary object of the present invention to provide a very useful illuminated headgear that has a flexible long flat electroluminescent EL light Strip with an eye-catching power pack with easy attachment for low cost manufacturing. This can offer all people who are concerned with safety appropriate headgear when doing outdoor activities, etc.

It is another object of the present invention to provide a new illuminated headgear which utilizes velcro to attach an electroluminescent light strip on the headgear without concerning the material of the headgear.

It is another object of the present invention to provide a new illuminated headgear which has a one-layer transparent enclosure to enclose the EL light strip thus saving cost comparing to conventional four-layer transparent enclosure.

It is another object of the present invention to provide a new illuminated headgear which has transparent printing or nontransparent printing on the transparent one-layer transparent enclosure thus creating designs (patterns) of light.

It is another object of the present invention to provide a new illuminated headgear which utilizes velcro to attach a power box on the headgear thus allowing a user to replace a dry battery in the power box by releasing the velcro.

It is another object of the present invention to provide a new illuminated headgear which has the circuit portion made in an integrated circuit chip to provide different kinds of lighting manners in combination such as flashing on-off, steady on, chasing, sequentially fade in-out.

From the above six major points and improvements on structures and features comparing to the prior art, it can be concluded that the present invention is more specific and practical to make a headgear item with EL light strip attached thereon than the prior art.

This and other objects of the invention will become clear from reviewing the preferred embodiment with the accompanying drawings.

DETAILED DESCRIPTION OF EMBODIMENTS

Figure 1:
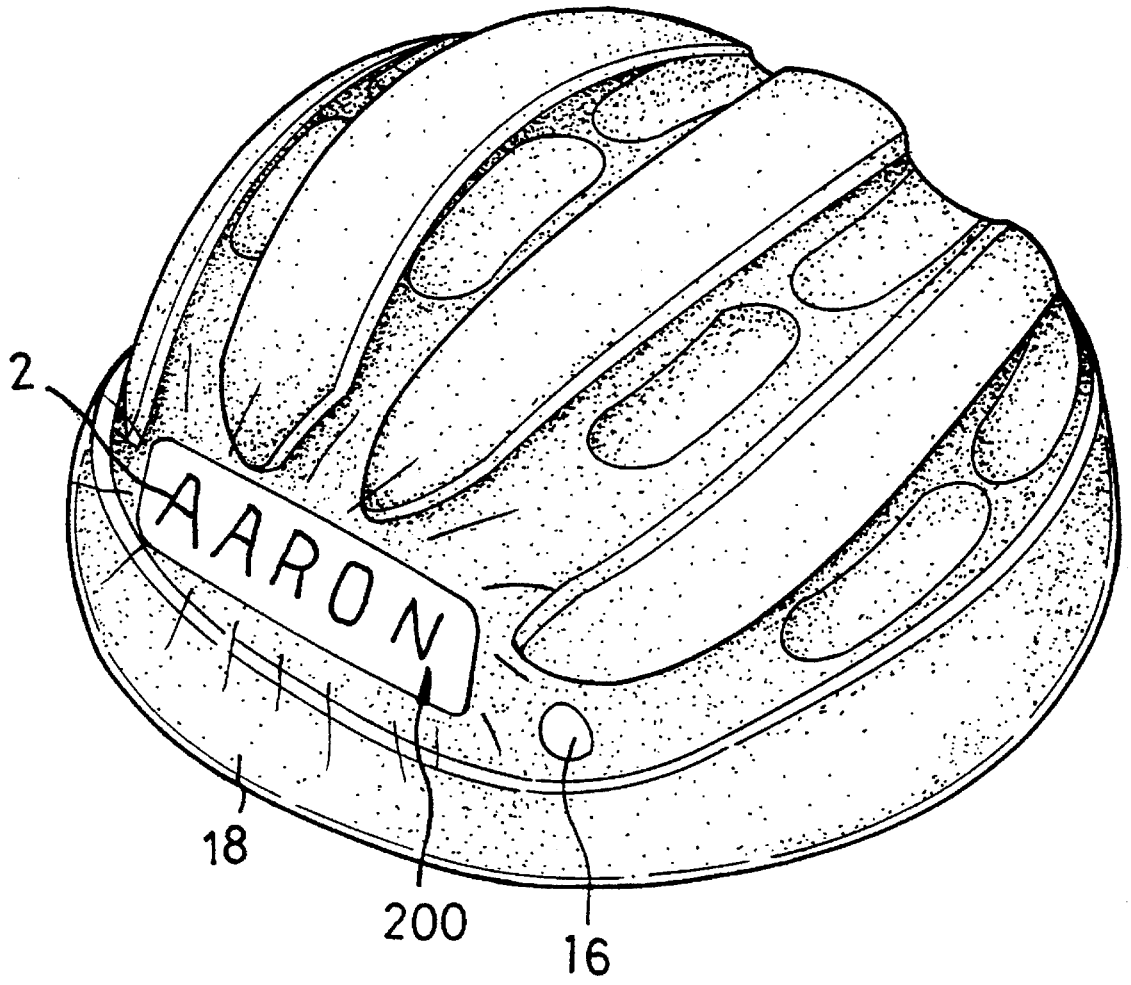
FIG. 1 is a perspective view of a bicycle helmet which uses an EL light strip in accordance with the preferred embodiment of the present invention.
Figure 2:
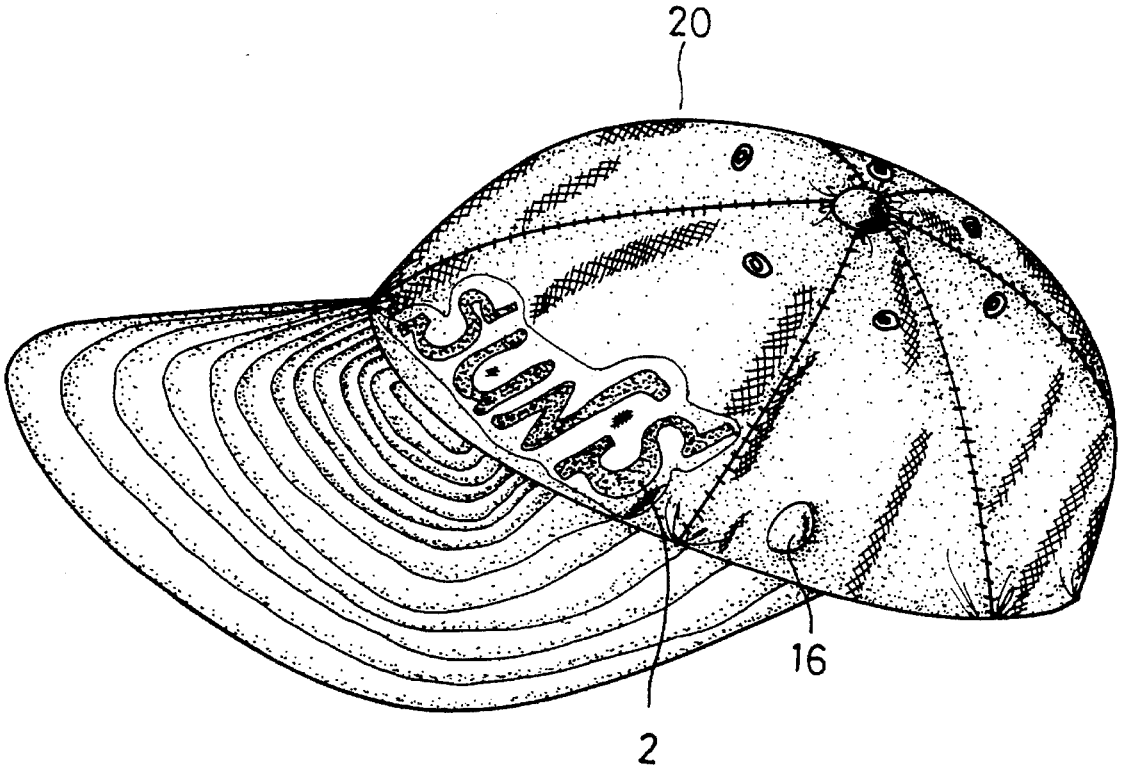
FIG. 2 is a perspective view of a cap which uses an EL light strip in accordance with the preferred embodiment of the present invention.
Figure 3:
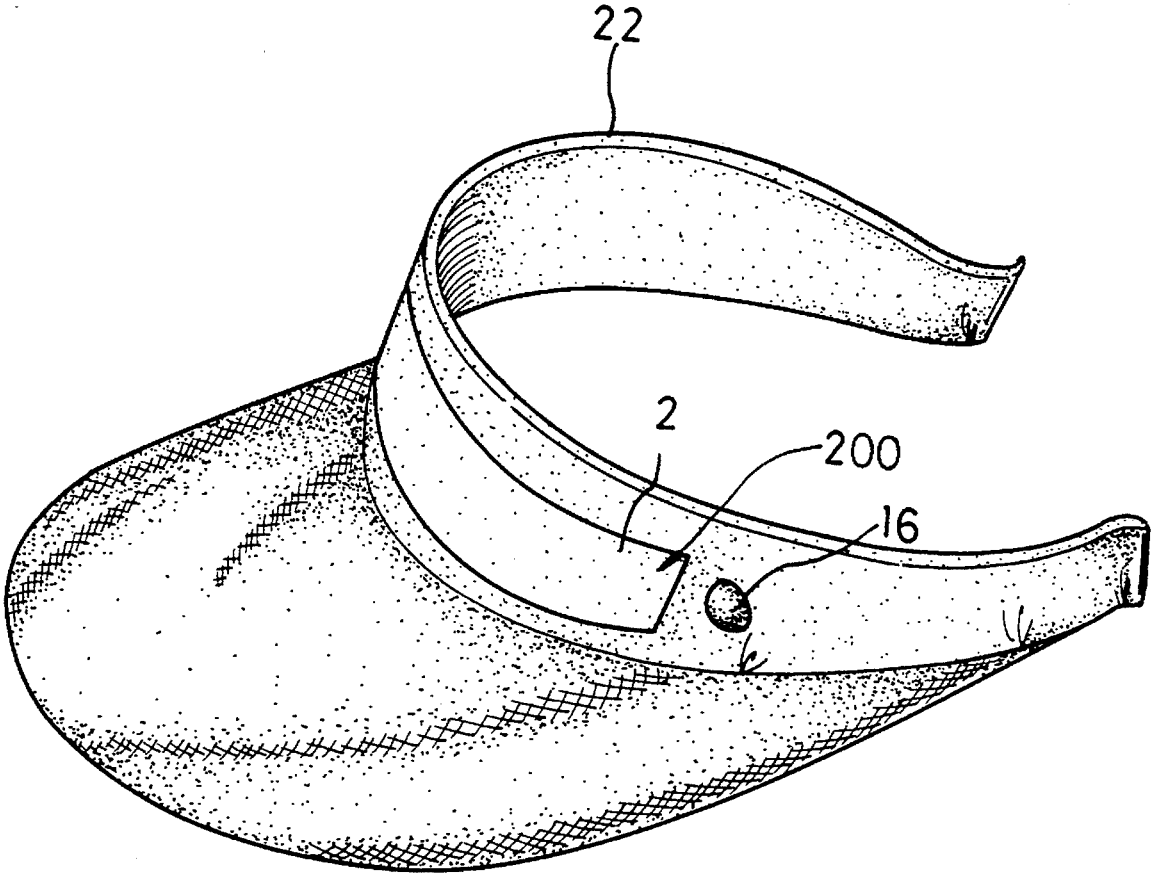
FIG. 3 is a perspective view of a visor which uses an EL light strip in accordance with the preferred embodiment of the present invention.

FIGS. 1–3 show three types of headgear. FIG. 1 shows a helmet 18 for a bicycle rider. FIG. 2 shows a cap 20 for a baseball player. FIG. 3 shows a visor 22 for a golf player. Each of the headgear items uses an electroluminescent EL light strip 2 which is taught in the applicant's co-pending U.S. patent application Ser. No. 08/156,004. Each EL light strip 2 is attached to one of the headgear items by means of stitches or a velcro. Each EL light strip 2 is enclosed in a transparent enclosure 200. For improving the light pattern of the light strip 2, a light pattern (design) is printed with colors of transparent ink on the enclosure 200. The light pattern (design) is easily visible when the EL light strip 2 is activated by electrical power. The enclosure 200 can be alternatively printed with nontransparent ink thus another light pattern (design) is visible when the EL light strip 2 is activated by electrical power.

Figure 4:
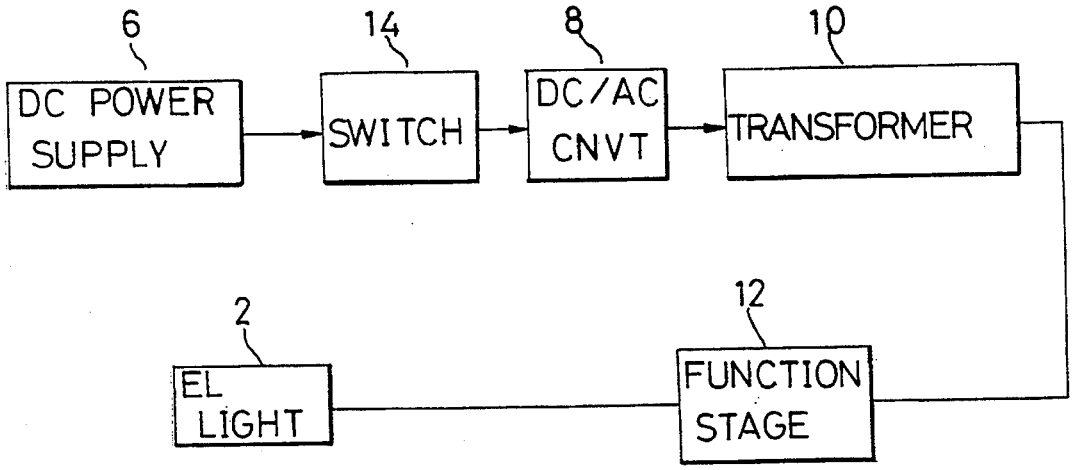
FIG. 4 is a block diagram of a power pack for powering the EL light strip of the present invention.
Figure 5:
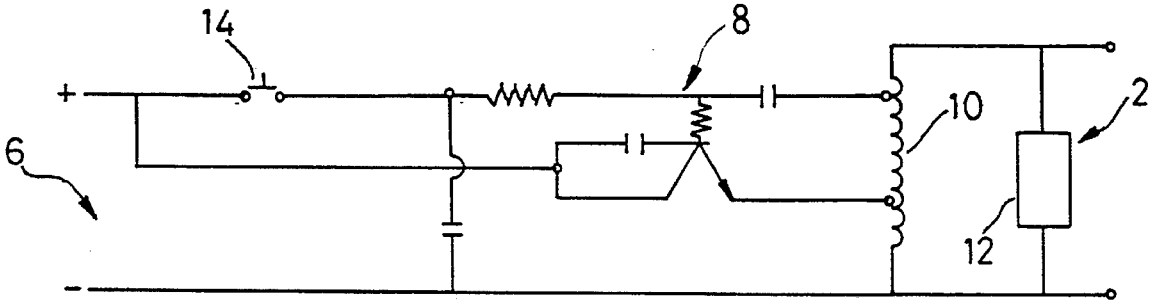
FIG. 5 shows a circuit for powering the EL light strip of the present invention.

Referring to FIGS. 4 and 5, the EL light strip 2 is powered by means of a circuit 4. The circuit 4 includes a direct current (DC) power supply 6 which is connected to a switch 14 which is connected to a direct-current-to-alter- nating-current converter 8 (DC/AC converter). The DC/AC converter 8 is connected by means of a transformer 10 to a function stage 12. The function stage 12 is connected to the EL light strip 2.

The DC power supply 6 is used to provide electricity for the EL light strip 2. For convenience, the DC power supply 6 is preferably a dry battery so that it is easily attachable to the headgear.

A direct current is sent from the DC power supply 6 to the DC/AC convertor 8 when the switch 14 is turned on. The direct current is converted into an alternating current by means of the DC/AC convertor 8. The DC/AC convertor 8 can be appropriately selected in order to provide a desired frequency of the alternating current.

The alternating current is sent from the DC/AC convertor 8 to the transformer 10. The voltage of the AC current is increased by means of the transformer 10. Therefore, the DC/AC converter 8 together with the transformer 10 convert a DC current into an AC current with a required voltage and frequency to activate the electroluminescent light strips 2.

The voltage-increased alternating current (AC) is sent from the transformer 10 to the function stage 12. The function stage 12 makes possible various ways in which the EL light strips flash, by providing a plurality of options which include "regular short interval flashing", "permanent 'ON'", "regular short interval flashing interspersed with regular 'OFF' periods", "irregular interval flashing" and "phased-in and phased-out flashing". The function stage 12 is an integral circuit or any other well known devices which are commercially available and thus is not described in detail herein.

The EL light strips can be turned on and off by means of the switch 14.

Figure 6:
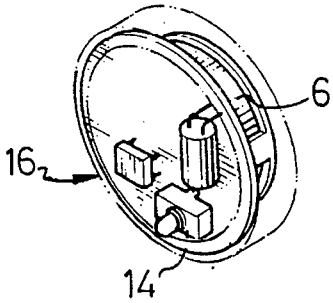
FIG. 6 is a perspective view of the circuit which is received in a housing.

Referring to FIG. 6, the dry battery 6, the switch 14, and other electrical components as mentioned are contained in a housing 16. The housing 16 is attached to any one of the headgear items as shown in FIGS. 1 to 3 by means of a velcro tape.

Figure 7:
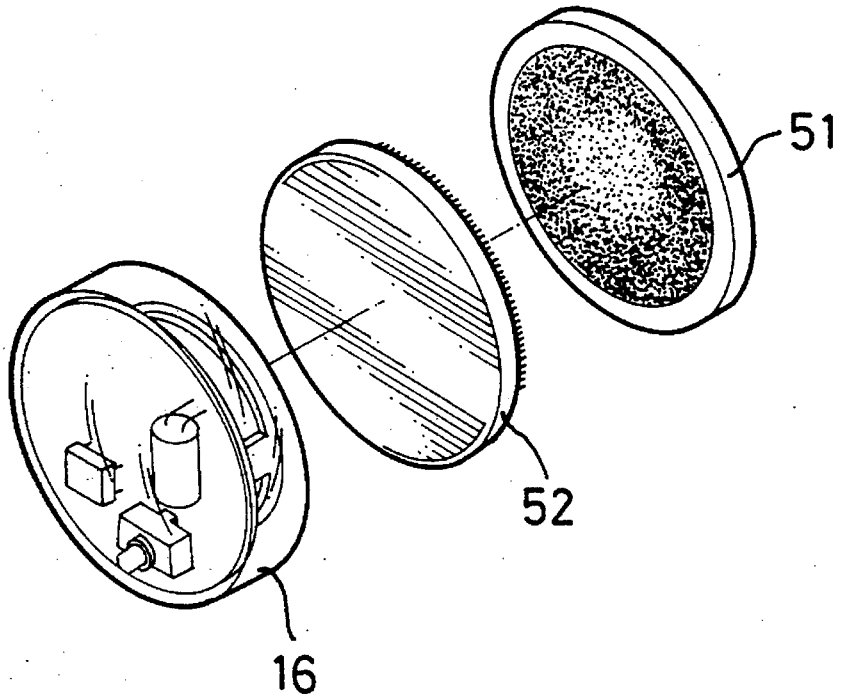
FIG. 7 is an exploded view showing a circuit housing and a velcro tape used for attaching the circuit housing onto a headgear item in this invention.

Referring to FIG. 7, the housing 16 is attached to any one of the headgear items as shown in FIGS. 1 to 3 by a velcro tape which is composed of a loop pile 51 and a hook pile 52. A velcro composed of a loop pile 51 and a hook pile 52 is used to attach the housing 16 onto the headgear items as Shown in FIGS. 1 to 3. Therefore, the user can replace the dry battery 6 easily by detaching the housing 16 from the headgear item without destroying the housing 16 and the circuit therein.

Figure 10:
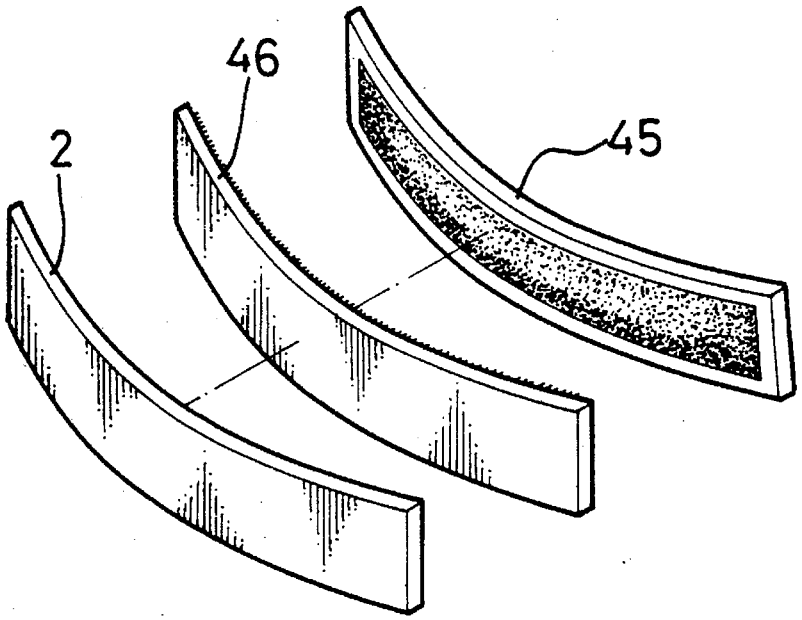
FIG. 10 is an exploded view showing an EL light strip and a velcro tape used for attaching the EL light strip onto the visor as shown in FIG. 3.
Figure 8:
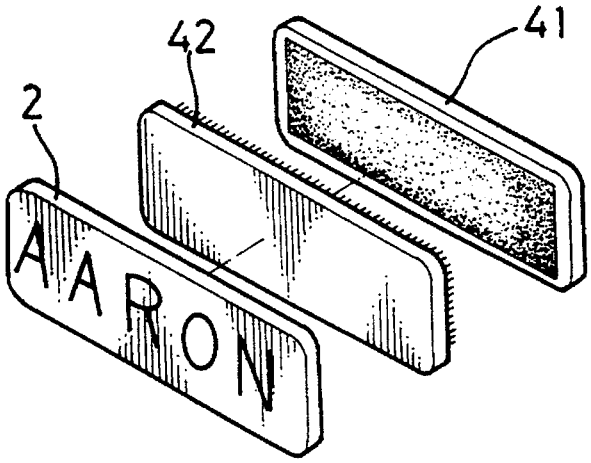
FIG. 8 is an exploded view showing an EL light strip and a velcro tape used for attaching the EL light strip onto the helmet as shown in FIG. 1.
Figure 9:
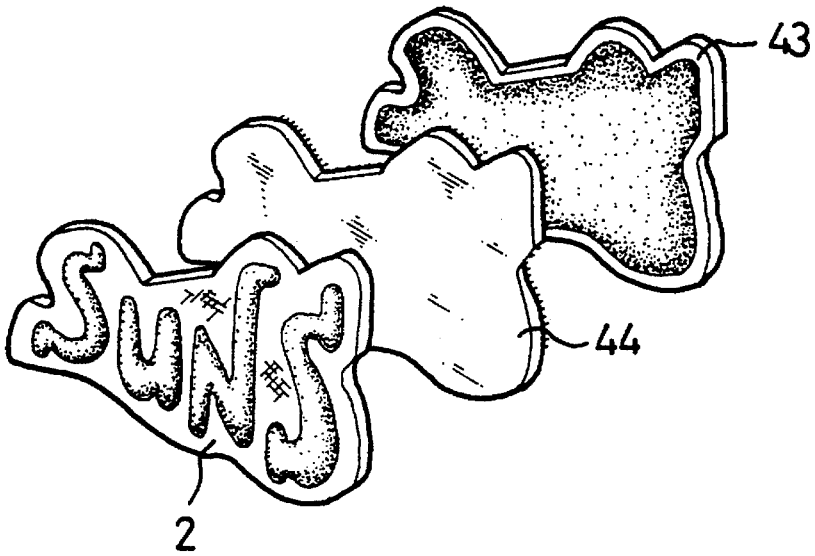
FIG. 9 is an exploded view showing an EL light strip and a velcro tape used for attaching the EL light strip onto the cap as shown in FIG. 2.

Referring to FIG. 8, the EL light strip 2 of FIG. 1 is shown independently from the helmet 18, with a velcro tape being composed of a loop pile 41 and a hook pile 42 attached between the EL light strip 2 and the helmet 18. Referring to FIG. 9, the EL light strip 2 of FIG. 2 is shown independently from the helmet 18, with a velcro tape being composed of a loop pile 41 and a hook pile 42 attached between the EL light strip 2 and the cap 20. Referring to FIG. 10, the EL light strip 2 of FIG. 3 is shown independently from the visor 22, with a velcro tape being composed of a loop pile 45 and a hook pile 46 attached between the EL light strip 2 and the visor 22.

What is claimed is:

1. An item of headgear attached with an electroluminescent EL light strip comprising:

a direct current power source for providing a direct current;

a switch electrically connected to the direct current power source;

a direct current/alternating current converter electrically connected to the direct current power source via the switch for converting the direct current from the direct current power source to an alternating current with a predetermined frequency;

a transformer electrically connected to the direct current/alternating current converter for amplifying the alternating current therefrom to have a predetermined voltage;

a function stage electrically connected to the transformer for generating different pulses in response to reception the alternating current from the transformer;

at least one electroluminescent EL light strip electrically connected to the function stage for receiving the pulses and activated thereby to be lit;

a transparent enclosure for receiving the EL light strip therein;

an attachment media for attaching the sleeve including the electroluminescent EL light strip onto the headgear;

a waterproof housing for receiving the direct current power source, the switch, the direct current/alternating current converter, the transformer, and the function stage and being attached on the headgear by means of double-sided tape.

2. An item of headgear as claimed in claim 1 wherein the transparent enclosure is made of soft-and-stitchable material.

3. An item of headgear as claimed in claim 1 wherein the attachment media is double-sided tape.

4. An item of headgear as claimed in claim 1 wherein the attachment media is velcro.

5. An item of headgear as claimed in claim 1 wherein the attachment media is stitching.

6. An item of headgear as claimed in claim 1 Wherein the transparent enclosure is printed with nontransparent ink by silk-screen printing thus forming a viewing design for the electroluminescent EL light strip.

7. An item of headgear as claimed in claim 1 wherein the electroluminescent EL light strip illuminates in a manner of flashing on-off in response to reception of power from the function stage.

8. An item of headgear as claimed in claim 1 wherein the electroluminescent EL light strip illuminates in a manner of steady on in response to reception of power from the function stage.

9. An item of headgear as claimed in claim 1 wherein the electroluminescent EL light strips illuminate in a manner of chasing in response to reception of pulses from the function stage.

10. An item of headgear as claimed in claim 1 wherein the electroluminescent EL light strips illuminate in a manner of sequentially fade in-out in response to reception of pulses from the function stage.

11. An item of headgear as claimed in claim 1 wherein the switch is a pressure-sensitive switch.

12. An item of headgear as claimed in claim 1 wherein the switch is a vibration switch.

13. An item of headgear as claimed in claim 1 wherein the switch is a motion sensor switch.

14. An item of headgear as claimed in claim 1 wherein the switch is a wetness sensor switch.

15. An item of headgear as claimed in claim 1 wherein the switch is a photosensor switch.

16. An item of headgear as claimed in claim 1 wherein the switch is a magnetic switch.

17. An item of headgear as claimed in claim 1 wherein the switch is a tilt-sensitive switch.

18. An item of headgear as claimed in claim 1 wherein the electroluminescent EL light strip is shaped to be a message.

19. An item of headgear as claimed in claim 1 wherein the electroluminescent EL light strip is shaped to be a logogram.

20. An item of headgear as claimed in claim 1 wherein the electroluminescent EL light strip is shaped to be a cartoon figure.

21. An item or headgear as claimed in claim 1 wherein the housing is attached to the headgear by means of velcro.

22. An item of headgear as claimed in claim 1 wherein the housing is attached to the headgear by means of stitching.

23. An item of headgear as claimed in claim 1 wherein the housing is attached to the headgear by means of double-sided tape.

24. An item of headgear as claimed in claim 1 wherein the transparent enclosure is printed with colored transparent ink for forming a light design for the electroluminescent EL light strip therein.

25. An item of headgear as claimed in claim 1 wherein the transparent enclosure is printed with nontransparent ink for forming a light design for the electroluminescent EL light strip therein.

* * * * *